US007076068B2

(12) United States Patent
Sotome et al.

(10) Patent No.: US 7,076,068 B2
(45) Date of Patent: Jul. 11, 2006

(54) THREE-DIMENSIONAL SOUND REPRODUCING APPARATUS AND A THREE-DIMENSIONAL SOUND REPRODUCTION METHOD

(75) Inventors: Hiromi Sotome, Hamamatsu (JP); Shigeo Ando, Hamamatsu (JP); Shinichi Muramatsu, Hamamatsu (JP); Akio Takahashi, Hamamatsu (JP); Hiroshi Iriyama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 274 days.

(21) Appl. No.: 10/231,741

(22) Filed: Nov. 25, 2002

(65) Prior Publication Data

US 2003/0086572 A1 May 8, 2003

Related U.S. Application Data

(62) Division of application No. 08/878,949, filed on Jun. 19, 1997.

(30) Foreign Application Priority Data

Jun. 21, 1996 (JP) ..... 8-162154
Jun. 21, 1996 (JP) ..... 8-162155

(51) Int. Cl.
*H04R 5/00* (2006.01)

(52) U.S. Cl. ..... 381/17; 381/18; 381/309

(58) Field of Classification Search ..... 381/300, 381/303, 307, 309, 310, 1, 17–23, 27; 369/4, 369/5, 86, 87, 89, 91, 92
See application file for complete search history.

(56) References Cited

U.S. PATENT DOCUMENTS 3,236,949 A * 2/1966 Atal et al. ..... 381/1
4,118,599 A * 10/1978 Iwahara et al. ..... 381/1
4,209,665 A * 6/1980 Iwahara ..... 381/310
4,349,698 A * 9/1982 Iwahara ..... 381/1
4,680,796 A 7/1987 Blackmer et al. ..... 381/16
4,910,779 A 3/1990 Cooper et al. ..... 381/26
5,025,472 A 6/1991 Shimizu et al.
5,027,687 A 7/1991 Iwamatsu
5,105,462 A * 4/1992 Lowe et al. ..... 381/17
5,261,005 A 11/1993 Masayuki
5,381,482 A 1/1995 Matsumoto ..... 381/18
5,440,639 A 8/1995 Suzuky et al. ..... 381/17

(Continued)

FOREIGN PATENT DOCUMENTS

EP 0 666 556 A2 3/1995

(Continued)

*Primary Examiner*—Xu Mei
(74) *Attorney, Agent, or Firm*—Pillsbury Winthrop Shaw Pittman LLP

(57) ABSTRACT

A three-dimensional sound reproducing apparatus is configured by cascading a sound field effect adding unit and a crosstalk canceling unit. The sound field effect adding unit adds a predetermined three-dimensional sound field effect to an input audio signal, thereby generating audio signals respectively corresponding to left and right channels. The crosstalk canceling unit performs a calculation process on the audio signals of the two channels so that, when the audio signals are respectively generated by two loudspeakers positioned in front of a listener, the audio signals reach the left and right ears of the listener without producing crosstalk. The resulting audio signals are supplied to the loudspeakers, respectively. A sound image localizing unit receives two-channel audio signals which are obtained by encoding a center-channel audio signal, a left-channel audio signal, a right-channel audio signal, and a nonlocalization audio signal, and outputs two-channel audio signals in which sound images are to be respectively localized at virtual loudspeakers.

5 Claims, 14 Drawing Sheets

U.S. PATENT DOCUMENTS 5,452,360 A 9/1995 Yamashita et al.
5,459,790 A * 10/1995 Scofield et al. ..... 381/310
5,524,053 A 6/1996 Iwamatsu
5,579,396 A * 11/1996 Iida et al. ..... 381/18
5,585,587 A 12/1996 Inoue et al.
5,604,809 A 2/1997 Tsubonuma et al. ..... 381/17
5,742,689 A 4/1998 Tucker et al. ..... 381/17
5,999,630 A 12/1999 Iwamatsu

FOREIGN PATENT DOCUMENTS

JP 06030500 A * 2/1994
JP 7092968 12/1996
JP 8146974 12/1999

* cited by examiner

PRIOR ART

PRIOR ART

PRIOR ART

THREE-DIMENSIONAL SOUND REPRODUCING APPARATUS AND A THREE-DIMENSIONAL SOUND REPRODUCTION METHOD

RELATED APPLICATIONS

This application is a divisional application of U.S. patent application Ser. No. 08/878,949, filed Jun. 19, 1997.

BACKGROUND OF THE INVENTION

1. Field of the Invention

This invention relates to a three-dimensional sound reproducing apparatus which conducts sound reproduction with adding sound field effects corresponding to various three-dimensional acoustic spaces such as a concert hall, to an audio signal, and also to a three-dimensional sound reproduction method which can provide a listener with a three-dimensional sound with enhanced presence.

2. Background

In a three-dimensional acoustic space such as a concert hall, a sound generated by the player and the like is reflected from various portions such as walls of the hall and then reaches the listener's ear in the form of reverberation sounds from various directions. Such reverberation sounds from various directions function as a source of producing presence specific to the three-dimensional acoustic space. As an acoustic system which is intended to reproduce presence of a play in such a three-dimensional acoustic space with high fidelity, known is a so-called multispeaker system. In a multispeaker system, a number of loudspeakers which are arranged so as to surround a listener generate a sound and the volume of the sound is controlled, whereby a sound having an arbitrary sound location can be reproduced. Consequently, an impression that reverberation sounds seem to arrive from various directions, i.e., presence which is similar to that obtained in a three-dimensional acoustic space such as a concert hall can be given to the listener.

As described above, a so-called multispeaker system can provide a listener with a three-dimensional sound with rich presence. FIG. 17 shows an example of the configuration of such a multispeaker system. In the figure, SC designates a center localization loudspeaker which is driven by a center-channel audio signal C, SL designates a left localization loudspeaker which is driven by a left-channel audio signal L, SR designates a right localization loudspeaker which is driven by a right-channel audio signal R, and SN1 to SN7 designate nonlocalization loudspeakers which are driven by a nonlocalization audio signal N. As illustrated, these loudspeakers are arranged so,as to surround a listener M. The loudspeakers SC, SL, and SR output sounds which respectively have predetermined sound image locations. The loudspeakers SN1 to SN7 output nonlocalized sounds such as a voice of a person which is heard from nowhere. These sounds are heard by the listener M.

In place of the configuration in which all the loudspeakers shown in FIG. 17 are used, another configuration may be employed such as that in which the center localization loudspeaker SC is omitted and the center-channel audio signal C is supplied to the left and right localization loudspeakers SL and SR, or that in which, among the nonlocalization loudspeakers, only two loudspeakers SN3 and SN5 are used or only one loudspeaker SN4 is used.

The audio signals may be supplied to the loudspeakers in various manners. When the center-channel audio signal C, the left-channel audio signal L, the right-channel audio signal R, and the nonlocalization audio signal N are to be independently supplied, the audio signals are supplied to the corresponding loudspeakers via power amplifiers 301 to 304 as shown in FIG. 18.

In the case where a recording system for recording an audio signal, and a reproducing system for reproducing the audio signal are separated from each other, it is required to reduce the amount of information of the audio signal which is to be transmitted from the recording system to the reproducing system. Therefore, an encoder 1002 such as that shown in FIG. 19 is used in the recording system. Specifically, an amplifier 401 provides the center-channel audio signal C with attenuation of −3 dB. The output signal of the amplifier 401 is added by adders 402 and 403 to the left- and right-channel audio signals L and R. On the other hand, an amplifier 404 provides the nonlocalization audio signal N with attenuation of −3 dB. Phase shifters 405 and 406 respectively output a signal which leads in phase by 90 deg. the output signal of the amplifier 404, and that which lags in phase by 90 deg. the output signal. The output signals of the adder 402 and the phase shifter 405 are added to each other by an adder 407, and then output as a left-channel audio signal L'. The output signals of the adder 403 and the phase shifter 406 are added to each other by an adder 408, and then output as a fight-channel audio signal R'. In this way, audio signals of four channels are compressed into those of two channels, and then recorded onto a medium or transmitted via communication means.

When the two-channel audio signals obtained from the encoder are to be reproduced in a reproduction system, a decoder shown in FIG. 20 is used. The original four-channel audio signals L, R, C, and N are reconstructed from the two-channel audio signals L' and R' and then supplied to the corresponding loudspeakers. In FIG. 20, 411 and 412 designate adders, 413 designates a phase inverter, and 414 to 417 designate power amplifiers.

The multispeaker system described above is excellent from the viewpoints of the sound field effect and provision of a three-dimensional sound with enhanced presence. However, the system must be realized by a large-scaled configuration using a number of loudspeakers, and hence the system itself is very expensive. When the multispeaker system is to be used, the loudspeakers must be placed at respective predetermined positions, and hence a sound room of a substantially large area is required. In the multispeaker system, the sound image location is controlled by balancing the volumes of the outputs of the loudspeakers. When the volumes fail to be balanced, therefore, an impression that the sound is generated by a loudspeaker inevitably prevails. Consequently, there arises a problem in that it is difficult to control sound reproduction with enhanced presence.

On the other hand, in another example of a conventional electronic instrument shown in FIG. 9, left and right loudspeakers 201L' and 201R' are respectively placed at the end portions of the instrument, and a sound carrying a spacial impression is generated by adjusting the balance of the volumes of the sound outputs of the loudspeakers. In order to generate a sound carrying a spacial impression by such a volume adjustment, the loudspeakers 201L' and 201R' must be placed at positions which are separated from each other by a fixed distance or longer. Therefore, the conventional electronic instrument has a problem in that its width is inevitably increased.

SUMMARY OF THE INVENTION

The invention has been conducted in view of the circumstances described above. It is an object of the invention to provide a three-dimensional sound reproducing apparatus which can obtain a sound field effect equivalent to that obtained in a three-dimensional acoustic space, by using two loudspeakers only or without using a number of loudspeakers.

It is another object of the invention to provide a three-dimensional sound reproduction method which can provide a listener with a three-dimensional sound with plentiful presence, by using not a number of loudspeakers but two loudspeakers only.

The first aspect of the invention is a three-dimensional sound reproducing apparatus including: a sound field effect adding unit that adds a predetermined three-dimensional sound field effect to an input audio signal, thereby generating two- or left- and right-channel audio signals; and a crosstalk canceling unit that performs a calculation process on the audio signals of the two channels so that, when the audio signals are respectively generated by two loudspeakers positioned in front of a listener, the audio signals reach left and right ears of the listener without producing crosstalk.

The second aspect of the invention is a three-dimensional sound reproducing apparatus according to the first aspect of the invention and configured so that the sound field effect adding unit convolutes filter coefficient strings which are obtained by, when an impulse sound is generated from a virtual point in a three-dimensional acoustic space, sampling waveforms of reverberation sounds detected at two points in the acoustic space, to the input audio signal, thereby generating the two- or left- and right-channel audio signals.

The third aspect of the invention is a three-dimensional sound reproduction method, including the steps of: providing two-channel first audio signals defining sound images which are to be respectively localized on left and right sides of a listener by one of reproducing from a medium and receiving from an outside, the two-channel first audio signals to which a center-channel audio signal defining a sound image to be localized at a center is commonly added, and the two-channel first audio signals to which nonlocalization audio signals separated in phase by 180 deg. from each other are respectively added; conducting filtering processes respectively corresponding to transfer functions of paths from a virtual point in a three-dimensional acoustic space to left and right ears of the listener on the two-channel first audio signals, to generate two-channel second audio signals defining a sound image to be localized at the virtual point; and conducting a crosstalk canceling process on the two-channel second audio signals to generate two-channel third audio signals, so that, when the two-channel third audio signals are respectively generated by two loudspeakers positioned in front of the listener, the two-channel third audio signals reach the left and right ears of the listener without producing crosstalk.

The fourth aspect of the invention is a three-dimensional sound reproduction method, including the steps of: providing two-channel first audio signals defining sound images which are to be respectively localized on left and right sides of a listener, a center-channel audio signal defining a sound image to be localized at a center, and nonlocalization audio signals, by one of reproducing from a medium and receiving from an outside; conducting filtering processes respectively corresponding to transfer functions of paths from a virtual point in a three-dimensional acoustic space to left and right ears of the listener on the two-channel first audio signals, to generate two-channel second audio signals defining a sound image to be localized at the virtual point; conducting a phase shifting process on the nonlocalization audio signal to generate two-channel nonlocalization audio signals separated in phase by 180 deg. from each other; adding the center-channel audio signal commonly, and the two-channel nonlocalization audio signals respectively to the two-channel second audio signals to generate two-channel third audio signals; and conducting a crosstalk canceling process on the two-channel third audio signals to generate two-channel fourth audio signals, so that, when the two-channel fourth audio signals are respectively generated by two loudspeakers positioned in front of the listener, the two-channel fourth audio signals reach the left and right ears of the listener without producing crosstalk.

DETAILED DESCRIPTION OF THE PREFERRED EMBODIMENTS

Hereinafter, in order to further facilitate understanding of the invention, embodiments of the invention will be described. The embodiments show modes of the invention, but do not restrict the invention, and may be arbitrarily modified within the scope of the invention.

First Embodiment

Figure 1:
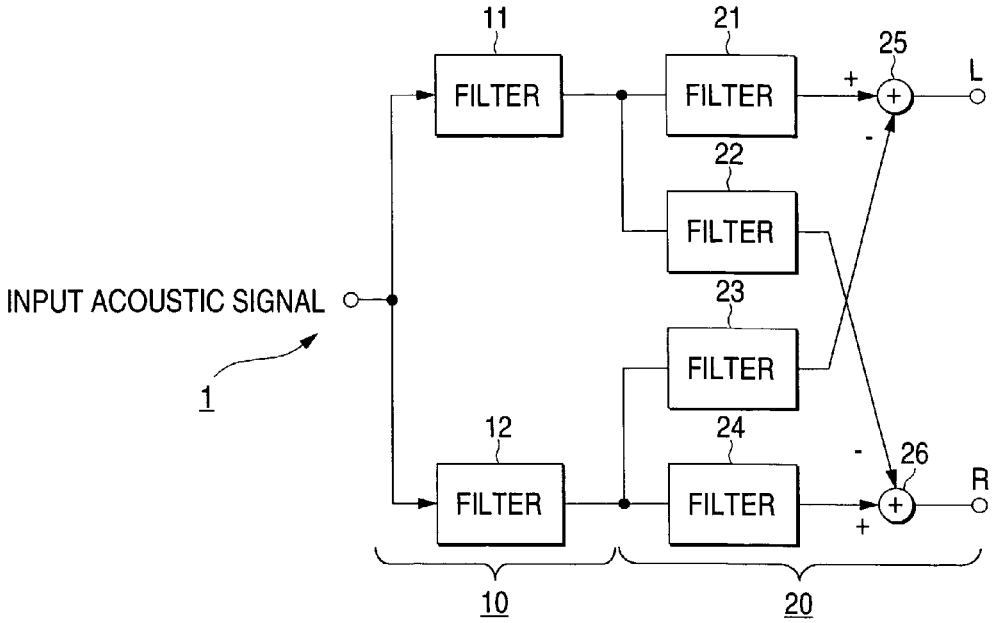
FIG. 1 is a block diagram showing the configuration of a sound field effect adding apparatus of a three-dimensional sound reproducing apparatus which is a first embodiment of the invention.

The three-dimensional sound reproducing apparatus and the three-dimensional sound reproduction method of the invention provide a listener with a sound to which a sound field effect corresponding to an arbitrary three-dimensional acoustic space is added, while using only two loudspeakers which are positioned in front of the listener. FIG. 1 is a block diagram showing the configuration of a sound field effect adding apparatus 1 which is the first embodiment of the invention.

The sound field effect adding apparatus 1 includes a sound field effect adding unit 10 which adds a sound field effect corresponding to a predetermined three-dimensional acoustic space to an input audio signal which is to be reproduced, and a crosstalk canceling unit 20 which conducts a process of canceling crosstalk on two-channel audio signals obtained from the sound field effect adding unit 10. As shown in the figure, the units are cascaded together. Two-channel audio signals obtained from the crosstalk canceling unit 20 are supplied to two- or left- and right-channel loudspeakers (not shown) which are positioned in front of the listener, respectively, and then given to the listener in the form of a sound to which a predetermined sound field effect is added.

The sound field effect adding unit 10 includes FIR (Finite Impulse Response) filters 11 and 12. The FIR filters 11 and 12 perform a calculation process of convoluting time-series sample data of waveforms of reverberation sound collected at two points of a predetermined three-dimensional acoustic space, as filter coefficient strings to the input audio signals (time-series sample data).

Figure 2:
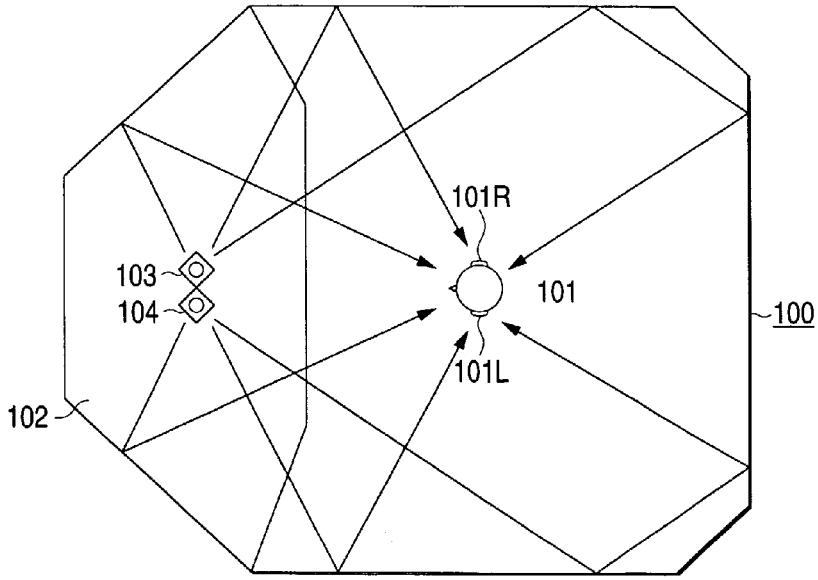
FIG. 2 is a view illustrating the function of the sound field effect adding apparatus.

The filter coefficient strings used in the convolution calculations of the FIR filters 11 and 12 are collected in an environment such as that shown in FIG. 2. In FIG. 2, 100 designates an example of a concert hall which is a three-dimensional acoustic space. As shown in the FIG. 2, a dummy head 101 is placed at the center of an orchestra in the concert hall 100. The dummy head 101 simulates the head of a human. A pair of microphones 101L and 101R corresponding to the left and right ears of a human are placed on the left and right sides of the dummy head, respectively. A sound source having two loudspeakers 103 and 104 is placed on a stage 102 in the front side of the concert hall 100. The loudspeakers simulate an instrument, a vocalist, or the like generating a sound on the stage 102. The conditions such as the number of loudspeakers, and the attitudes of the loudspeakers may be suitably selected in consideration of radiation characteristics of the sound source such as an instrument which is to be simulated. In this example, the two loudspeakers are used in order to radiate a sound in all directions (i.e., in order to make the radiation characteristics of the sound nondirectional).

In the configuration of the apparatus, the loudspeakers 103 and 104, as the sound source, generates an impulse sound. The impulse sound propagates along many paths which are indicated as examples by arrows in FIG. 2, and is reflected by walls and the like of the concert hall 100 to reach the microphones 101L and 101R of the dummy head 101. The microphones 101L and 101R collect the waveforms of reverberation sounds formed by synthesizing reverberation sounds from various directions with each other.

The waveforms of reverberation sounds (the waveforms of impulse responses) collected by the microphones 101L and 101R as described above are sampled at a predetermined sampling period. The sample data string of reverberation sound waveforms obtained from the microphone 101L are used as the filter coefficient string of the FIR filter 11, and the sample data string of reverberation sound waveforms obtained from the microphone 101R are used as the filter coefficient string of the FIR filter 12.

In the configuration of FIG. 1, the filter coefficient strings are convoluted to the input audio signal by the FIR filters 11 and 12. As a result of the convolution calculation, it is possible to obtain audio signals of waveforms strictly identical with those of reverberation sounds which, when the input audio signal is output as a sound from the loudspeakers 103 and 104 of FIG. 2, can be collected by the microphones 101L and 101R. The sound field effect adding unit functions in this way.

The crosstalk canceling unit 20 includes four filters 21 to 24 and two subtractors 25 and 26, and conducts a process of preventing crosstalk from occurring on the two-channel audio signals which are output from the sound field effect adding unit 10 as described above. The provision of the crosstalk canceling unit 20 enables the audio signals obtained from the sound field effect adding unit 10 to be transmitted to the left and right ears of the listener without producing crosstalk. In the embodiment, as described above, three-dimensional sound reproduction is conducted by using two loudspeakers. Since the crosstalk canceling unit 20 is employed, sounds corresponding to the two-channel audio signals output from the sound field effect adding unit 10 can be independently transmitted to the left and right ears of the listener irrespective of the distances between the loudspeakers and the listener. Therefore, presence which is strictly identical with that obtained in a three-dimensional acoustic space such as a concert hall can be given to the listener. The function of the crosstalk canceling unit 20 will be described later in more detail.

Figure 3:
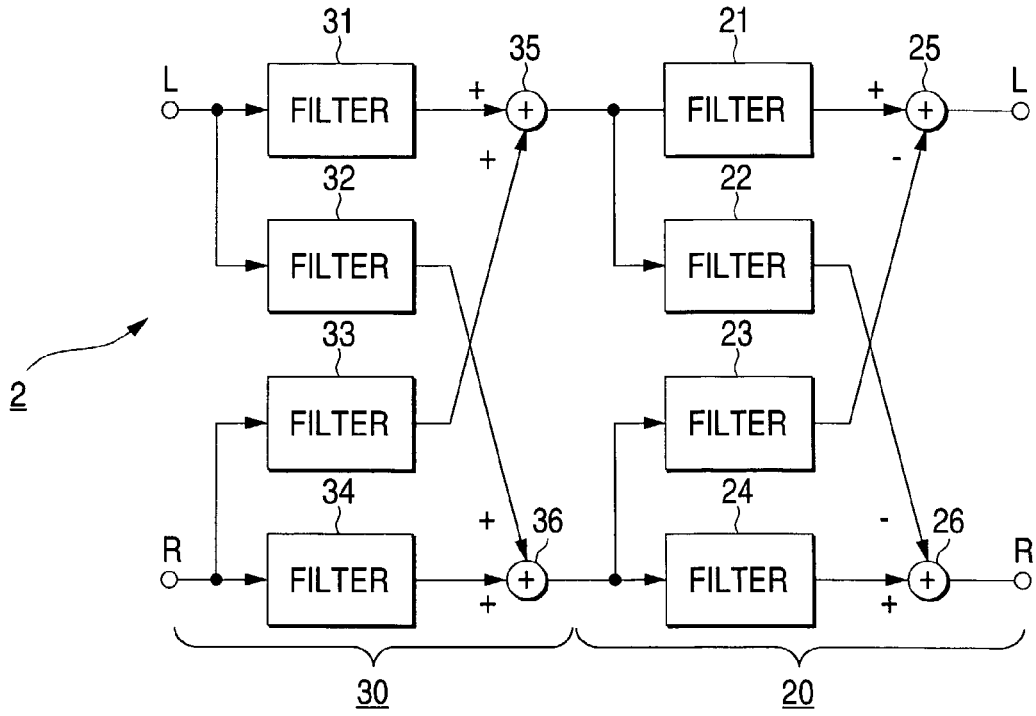
FIG. 3 is a block diagram showing the configuration of a sound image localizing apparatus of the embodiment.

In the above, the sound field effect adding apparatus 1 has been described. When a sound image localizing apparatus 2 such as shown in FIG. 3 is used in addition to the sound field effect adding apparatus, three-dimensional sound reproduction can be conducted with further enhanced presence. In the sound image localizing apparatus 2, a sound image localizing unit 30 which provides two- or left- and right-channel audio signals with an arbitrary sound image location, and a crosstalk canceling unit 20 which is strictly identical with that used in the sound field effect adding apparatus 1 are cascaded together as shown in the figure.

Figure 4:
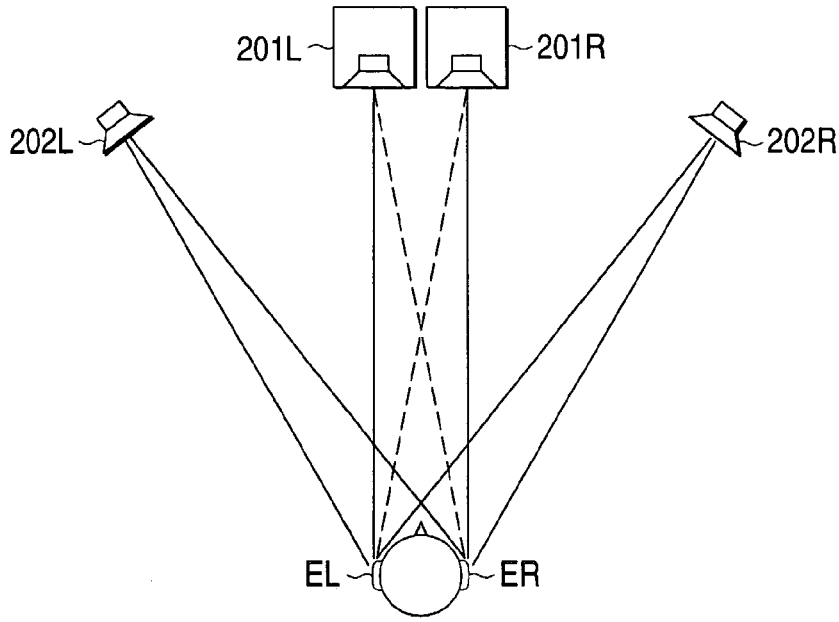
FIG. 4 is a view illustrating the function of the sound image localizing apparatus.
Figure 5:
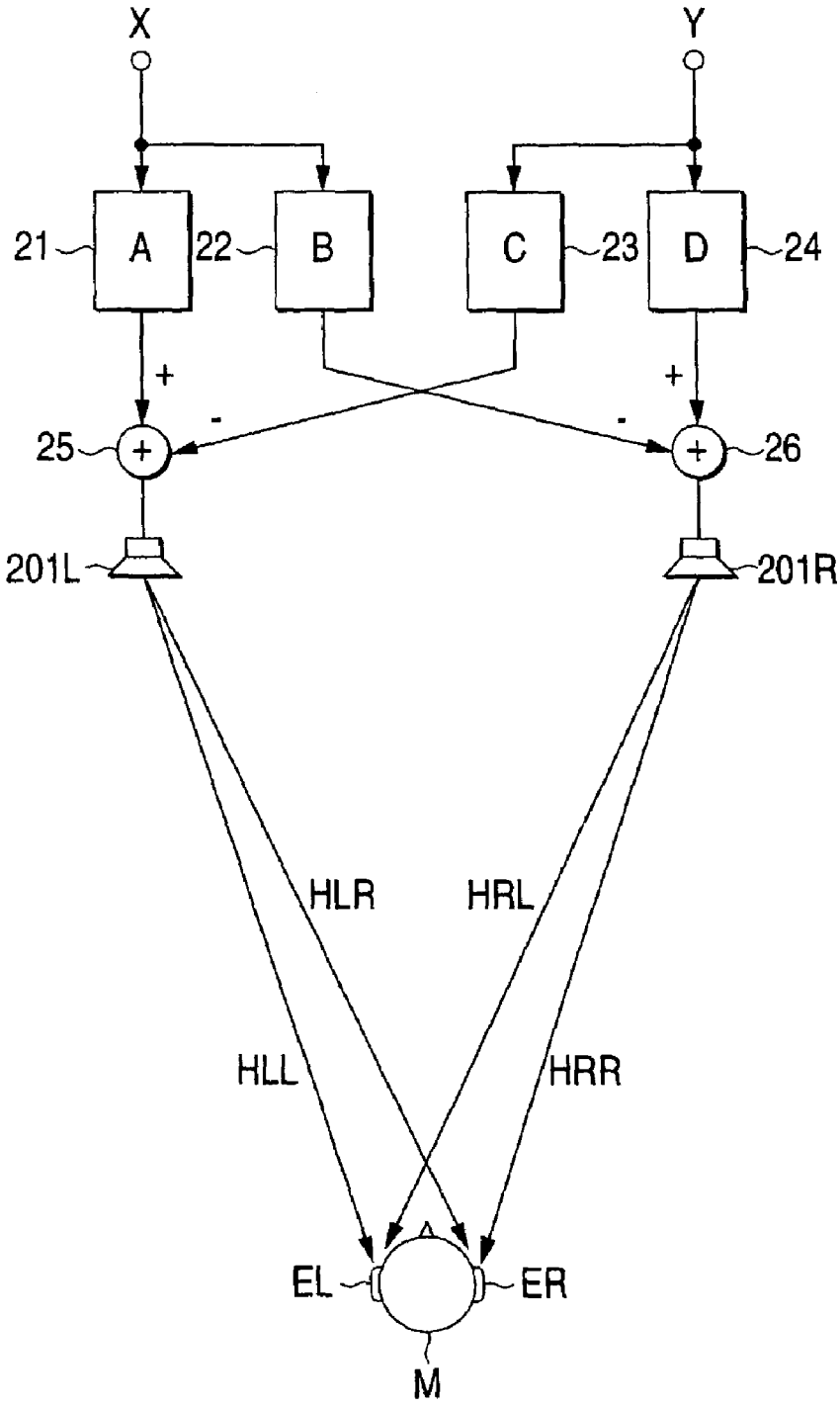
FIG. 5 is a view illustrating the function of a crosstalk canceling unit of the embodiment.
Figure 6:
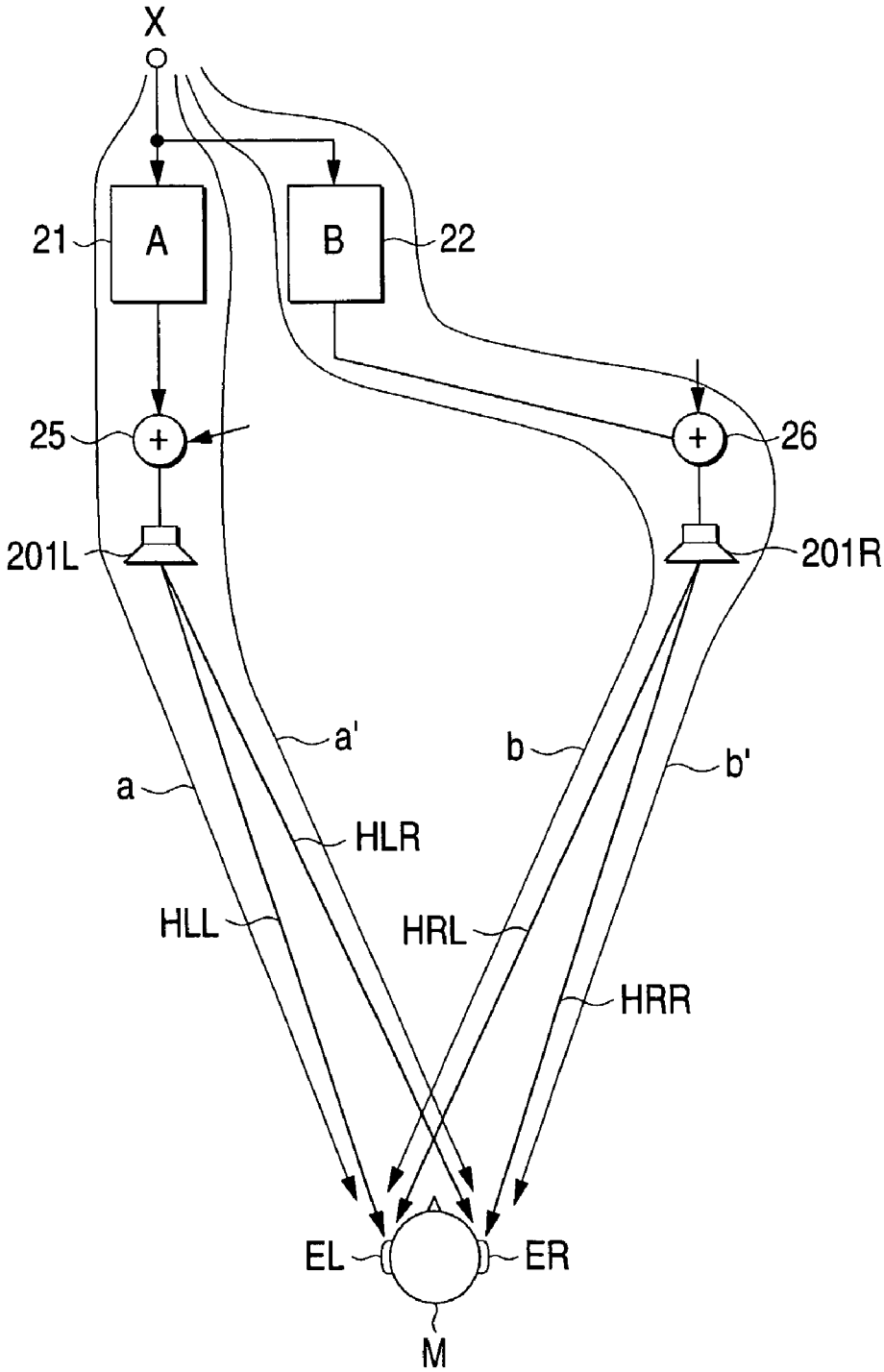
FIG. 6 is a view illustrating the function of the crosstalk canceling unit of the embodiment.

With reference to FIGS. 4 to 6, the function of the crosstalk canceling unit 20 will be described. In the embodiment, as described above, three-dimensional sound reproduction is conducted by using only two loudspeakers which are positioned in front of a listener. FIG. 4 shows an example of the manner of the reproduction. In the figure, 201L and 201R designate left and right loudspeakers used in the embodiment, M designates the head of the listener, and EL and ER designate the left and right ears of the listener.

As shown in the figure, sounds generated by the loudspeaker 201L (201R) include a sound which is transmitted to the ear EL (ER) of the listener along the path indicated by the solid line, and that which is transmitted to the ear ER (EL) of the listener along the path indicated by the broken line. The transmission of the latter sound is a phenomenon called crosstalk.

In sound reproduction, in order to obtain a desired sound field effect, it is required to eliminate such crosstalk or to cause a sound generated by the loudspeaker 201L (201R) to be transmitted only to the ear EL (ER) of the listener. However, loudspeakers must be placed with being separated from the ears of a listener by a substantial distance. Therefore, the use of loudspeakers inevitably produces the problem of crosstalk. To comply with this, a countermeasure is taken in which a predetermined process is conducted on two-channel audio signals which are to be originally produced and the resulting signals are supplied to the left and right loudspeakers 201L and 201R, thereby effectively eliminating crosstalk. The crosstalk canceling unit 20 shown in FIG. 3 or 1 is realizable the countermeasure.

FIG. 5 is a view illustrating the function of the crosstalk canceling unit 20. In the figure, X and Y designate the two- or left- and right-channel audio signals output from the sound image localizing unit 30 of FIG. 3 or the sound field effect adding unit 10 of FIG. 1, A to D designate transfer functions of the filters 21 to 24, respectively, HLL designates a transfer function of the path from the left loudspeaker 201L to the left ear EL of the listener, and HRR designates a transfer function of the path from the right loudspeaker 201R to the right ear ER of the listener. Furthermore, HLR and HRL designate a transfer function of the path from the left loudspeaker 201L to the right ear ER of the listener, and a transfer function of the path from the right loudspeaker 201R to the left ear EL of the listener, i.e., transfer functions of paths which produce crosstalk, respectively.

According to the crosstalk canceling unit 20, when the transfer functions A to D of the filters 21 to 24 are adequately selected, crosstalk components can be eliminated from sounds reaching the left and right ears of the listener. This will be specifically described below.

First, only a signal transmission system shown in FIG. 6 and corresponding to the left-channel audio signal X will be considered.

The audio signal X passes through the filter 21, the loudspeaker 201L, and the path of the transfer function HLL to tranmitted to left ear EL in the form of a sound a, and also through the filter 22, the loudspeaker 201R, function HRL to be transmitted to the left ear EL in the form of a sound b. The sounds a and b can be expressed as follows:

$$a=A\cdot HLL\cdot X \tag{1}$$

$$b=B\cdot HRL\cdot X \tag{2}$$

In order to transmit only a sound corresponding to the audio signal X to the left ear EL of the listener, the following must be held:

$$\begin{aligned} a+b &= A\cdot HLL\cdot X + B\cdot HRL\cdot X \\ &= X \end{aligned} \tag{3}$$

Therefore, the transfer functions A and B must satisfy the following condition:

$$A\cdot HLL+B\cdot HRL=1 \tag{4}$$

On the other hand, the audio signal X passes through the filter 21, the loudspeaker 201L, and the path of the transfer function HLR to be transmitted to the right ear ER in the form of a sound a', and also through the filter 22, the loudspeaker 201R, and the path of the transfer function HRR to be transmitted to the right ear ER in the form of a sound b'. The sounds a' and b' can be expressed as follows:

$$a'=A\cdot HLR\cdot X \tag{5}$$

$$b'=B\cdot HRR\cdot X \tag{6}$$

In order to eliminate crosstalk, the transmission of the audio signal X to the right ear ER of the listener must be eliminated, or the following condition must be satisfied:

$$\begin{aligned} a'+b' &= A\cdot HLR\cdot X + B\cdot HRR\cdot X \\ &= 0. \end{aligned} \tag{7}$$

Therefore, the transfer functions A and B must satisfy the following condition:

$$A\cdot HLR+B\quad HRR=0 \tag{8}$$

When A=−B·HRR/HLR obtained from expression (8) above is substituted in expression (4), the following is obtained:

$$-B\cdot(HRR/HLR)\cdot HLL+B\cdot HRL=1 \tag{9}$$

When this expression is solved for B, the following is obtained:

$$B=-HLR/(HLL\cdot HRR-HLR\cdot HRL) \tag{10}$$

When B of the above is substituted in expression (8) and the expression is solved for A, the following is obtained:

$$A=HRR/(HLL\cdot HRR-HLR\cdot HRL) \tag{11}$$

When filters having-such transfer functions A and B are used as the filters 21 and 22, therefore, a sound corresponding to the left-channel audio signal X can be transmitted only to the left ear EL of the listener.

In the above, the case of the left-channel audio signal X has been described. The same method can be applied to the right-channel audio signal Y, and the transfer functions C and D required in the filter s 23 and 24 are obtained as follows:

$$C=-HRL/(HLL\cdot HRR-HLR\cdot HRL) \tag{12}$$

$$D=HLL/(HLL\cdot HRR-HLR\cdot HRL) \tag{13}$$

In the case where the loudspeakers are placed so as to be bilaterally symmetrical as seen from the listener, HLL=HRR and HLR=HRL are held. In this case, the filters 21 to 24 may be designed on the basis of the transfer functions A, B, C, and D (in this case A=D and B=C) which are calculated under the conditions.

In the above, the function of the crosstalk canceling unit 20 of the embodiment has been described in detail.

Next, the sound image localizing unit 30 of FIG. 3 will be described. In the embodiment, as shown in FIG. 4, audio signals are converted into sounds by the loudspeakers 201L and 201R which are placed in front of the listener. The sound image localizing unit 30 makes sounds corresponding to the audio signals to be heard by the listener as if the sounds are generated by loudspeakers 202L and 202R (virtual loudspeakers which are not actually used) different from the loudspeakers 201L and 201R.

Figure 7:
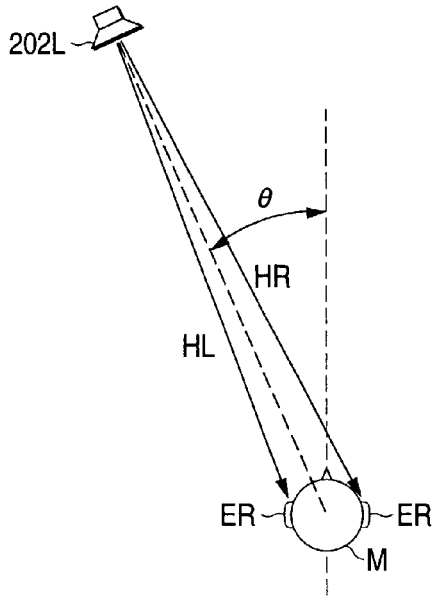
FIG. 7 is a view illustrating the function of the sound image localizing apparatus.

For the sake of simplicity, the case where the sound image of the left-channel audio signal is localized at the position of the virtual loudspeaker 202L of FIG. 4 will be described. FIG. 7 shows an example of the positional relationships between the virtual loudspeaker 202L and the left and right ears EL and ER of the listener. In this example, the virtual loudspeaker 202L is in the direction of an angle θ with respect to the front of the listener M, and a sound generated by the virtual loudspeaker 202L is transmitted to the left ear EL along the path of a transfer function HL and to the right ear ER along the path of a transfer function HR.

In order to localize the sound image of the left-channel audio signal at the position of the virtual loudspeaker 202L, filters having transfer functions which respectively correspond to the transfer functions HL and HR are used as filters 31 and 32. When the left-channel audio signal is supplied to the filters 31 and 32, audio signals of waveforms strictly identical with those of sounds which are heard by the left and right ears EL and ER of the listener when the audio signal is output as a sound from the virtual loudspeaker 202L of FIG. 3 are obtained from the filters.

The audio signals output from the filters are supplied to the left and right loudspeakers 201L and 201R (FIG. 4) via the crosstalk canceling unit 20. Therefore, sounds corresponding to the audio signals of the respective channels output from the filters of the sound image localizing unit 30 can be independently transmitted to the left and right ears of the listener irrespective of the distances between the loudspeakers 201L and 201R and the listener. As a result, the image of the sound heard by the listener can be correctly localized at the position of the virtual loudspeaker 202L.

In the above, the case of the left-channel audio signal has been described. Also the right-channel audio signal can be processed in the same manner. Namely, transfer functions for localizing the sound image of the audio signal at the position of the virtual loudspeaker 202R shown in FIG. 3 are previously obtained, and filters 33 and 34 having such transfer functions are used.

Figure 8:
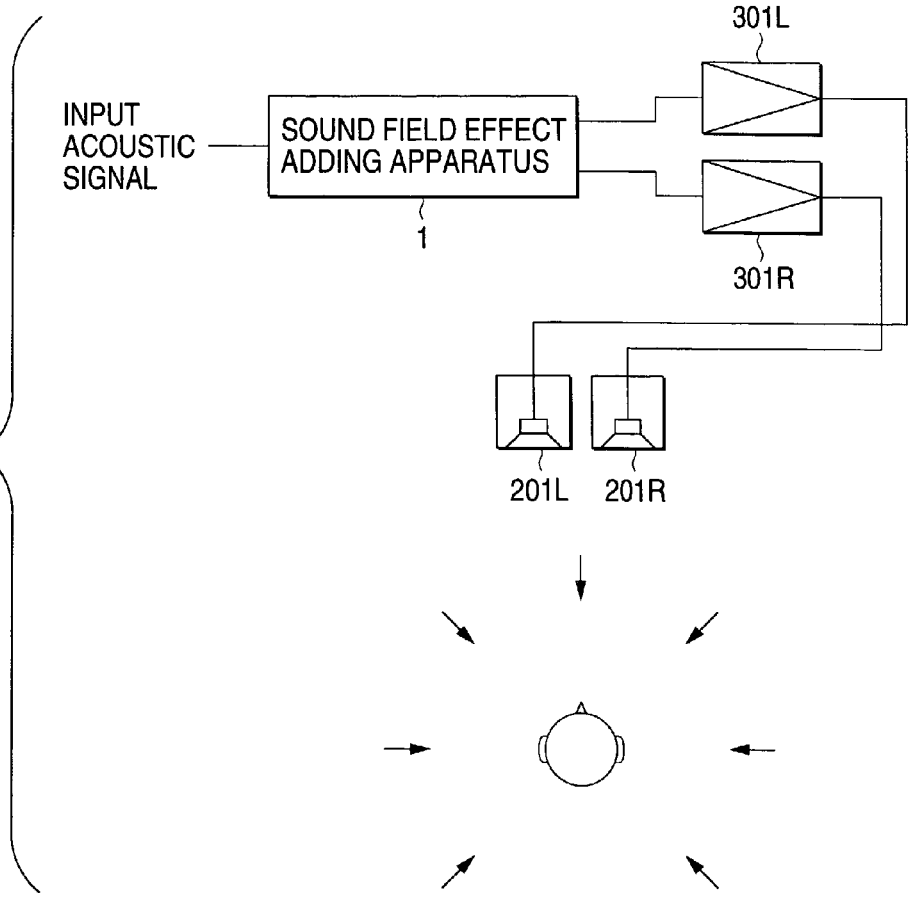
FIG. 8 is a view- showing an application example of the three-dimensional sound reproducing apparatus of the invention.

Next, a specific application example of the three-dimensional sound reproducing apparatus of the first embodiment will be described. In FIG. 8, an input audio signal is supplied to the sound field effect adding apparatus 1 (FIG. 1) described above, and two- or left- and right-channel audio signals obtained from the sound field effect adding apparatus 1 are supplied via power amplifiers 301L and 301R to the loudspeakers 201L and 201R which are placed in front of the listener. Namely, FIG. 8 shows a typical example of a three-dimensional sound reproducing apparatus using the sound field effect adding apparatus 1. According to the apparatus, an impression that reverberation sounds seem to arrive from various directions as indicated by the arrows can be given to the listener M, and a three-dimensional sound with plentiful presence can be provided.

Figure 10:
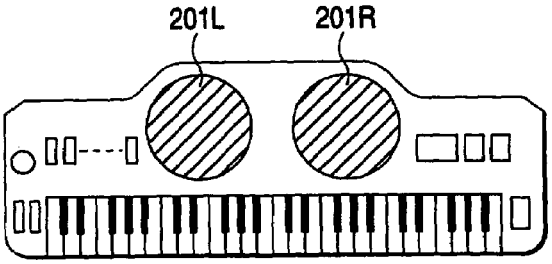
PRIOR ART FIG. 10
FIG. 10 is a view showing an application example of the three-dimensional sound reproducing apparatus of the invention.

Next, with reference to FIGS. 10 and 11, an example in which the three-dimensional sound reproducing apparatus of the first embodiment is applied to an electronic instrument will be described.

Figure 9:
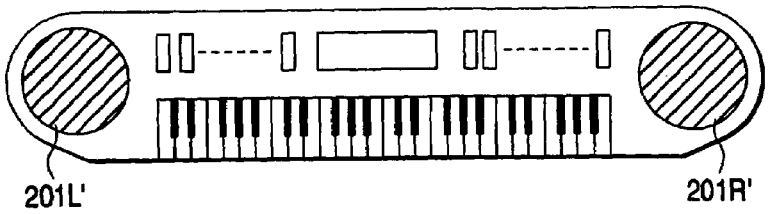
FIG. 9 is a view showing an example of a conventional electronic instrument.

The conventional electronic instrument shown in FIG. 9, has the problem in that its width is inevitably increased.

However, when the above-described sound field effect adding apparatus 1 or the sound image localizing apparatus 2 is used, a sound carrying a spacial impression can be generated by two loudspeakers which are placed in front of the listener (in the application example, the player of the electronic instrument). As shown in FIG. 10, therefore, the two loudspeakers 201L and 201R can be placed at the center of the electronic instrument, whereby the width of the electronic instrument can be shortened.

Figure 11:
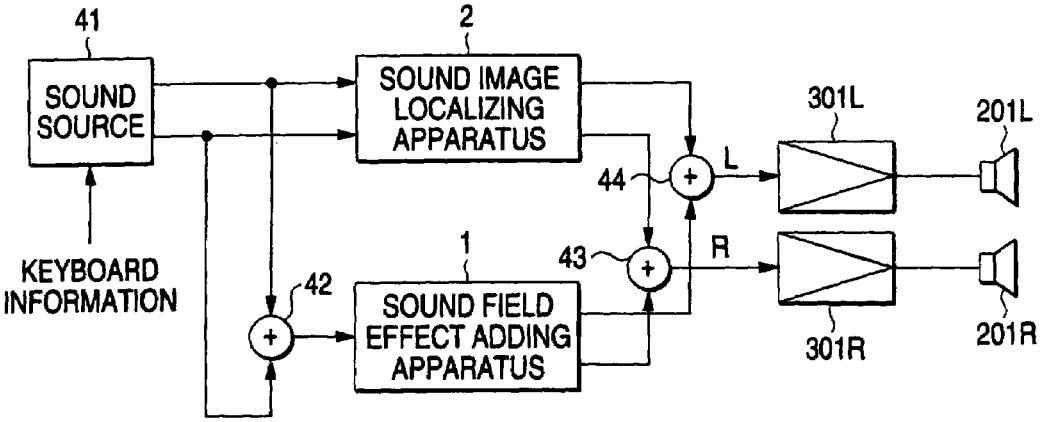
FIG. 11 is a view showing an application example of the three-dimensional sound reproducing apparatus of the invention.

FIG. 11 shows an example of a circuit configuration which is used in the case where the first embodiment is applied to an electronic instrument. In the illustrated example, two- or left- and right-channel audio signals are generated by a sound source 41 in accordance with the keyboard operation conducted by the player. The audio signals are supplied to the sound image localizing apparatus 2 (see FIG. 3) which has been described, and added to each other by an adder 42. The addition result is supplied to the sound field effect adding apparatus 1 (see FIG. 1) which has been described.

The sound image localizing apparatus 2 and the sound field effect adding apparatus 1 function in the same manner as those described above. Namely, the apparatuses output two- or left- and right-channel audio signals to which a predetermined sound image location is added, and two- or left- and right-channel audio signals to which a sound field effect corresponding to a predetermined three-dimensional acoustic space is added, respectively. The two- or left- and right-channel audio signals obtained from the sound image localizing apparatus 2, and those obtained from the sound field effect adding apparatus 1 are subjected to the adding operation by adders 43 and 44 in such a manner that the audio signals of the same channel are added to each other. The output signals of the adders 43 and 44 are supplied to the loudspeakers 201L and 201R via the power amplifiers 301L and 301R, respectively. As a result, the player can hear a sound having a predetermined sound image location, and a sound to which a sound field effect of a predetermined three-dimensional acoustic space is added.

This example is one of applications to which the first embodiment can be easily applied. Usually, the player plays the electronic instrument with opposing the two loudspeakers 201L and 201R and being separated from the instrument by a distance at which the playing operation is not impaired. Therefore, it is considered that the positional relationships between the loudspeakers 201L and 201R and the left and right ears of the player are substantially constant. Consequently, the signal processes of the sound field effect adding apparatus 1 and the sound image localizing apparatus 2 which are conducted on the basis of the positional relationships are exactly adequate, and the addition of the sound field effect and the sound image localization are performed as expected.

Figure 12:
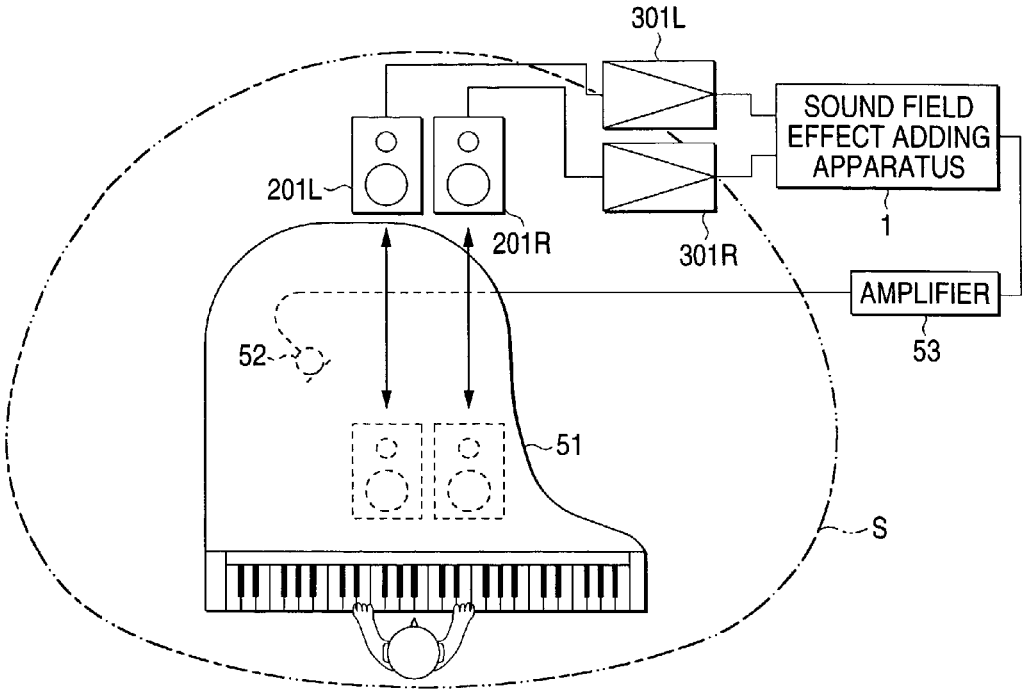
FIG. 12 is a view showing an application example of the three-dimensional sound reproducing apparatus of the invention.

FIG. 12 shows an example in which the first embodiment is applied to a piano practice room. As shown in the figure, a microphone 52 for collecting sounds of a piano performance is placed below the sound-board of a piano 51. The left and right loudspeakers 201L and 201R are placed at positions which are on the same level as or above the piano 51 and substantially in front of the piano player. An audio signal obtained from the microphone 52 is supplied via an amplifier 53 to the sound field effect adding apparatus 1 (see FIG. 1) which has been described. The two- or left- and right-channel audio signals obtained from the sound field effect adding apparatus 1 are output from the loudspeakers 201L and 201R via the power amplifiers 301L and 301R. As a result, the piano player can hear a sound to which a sound field effect of a three-dimensional acoustic space such as a concert hall is added. The distances between the loudspeakers 201L and 201R and the piano player may be adequately adjusted. The symbol S in FIG. 12 shows an example of an area where the sound field is formed. The piano player receives an impression that the piano player is in a concert hall or the like.

Figure 13:
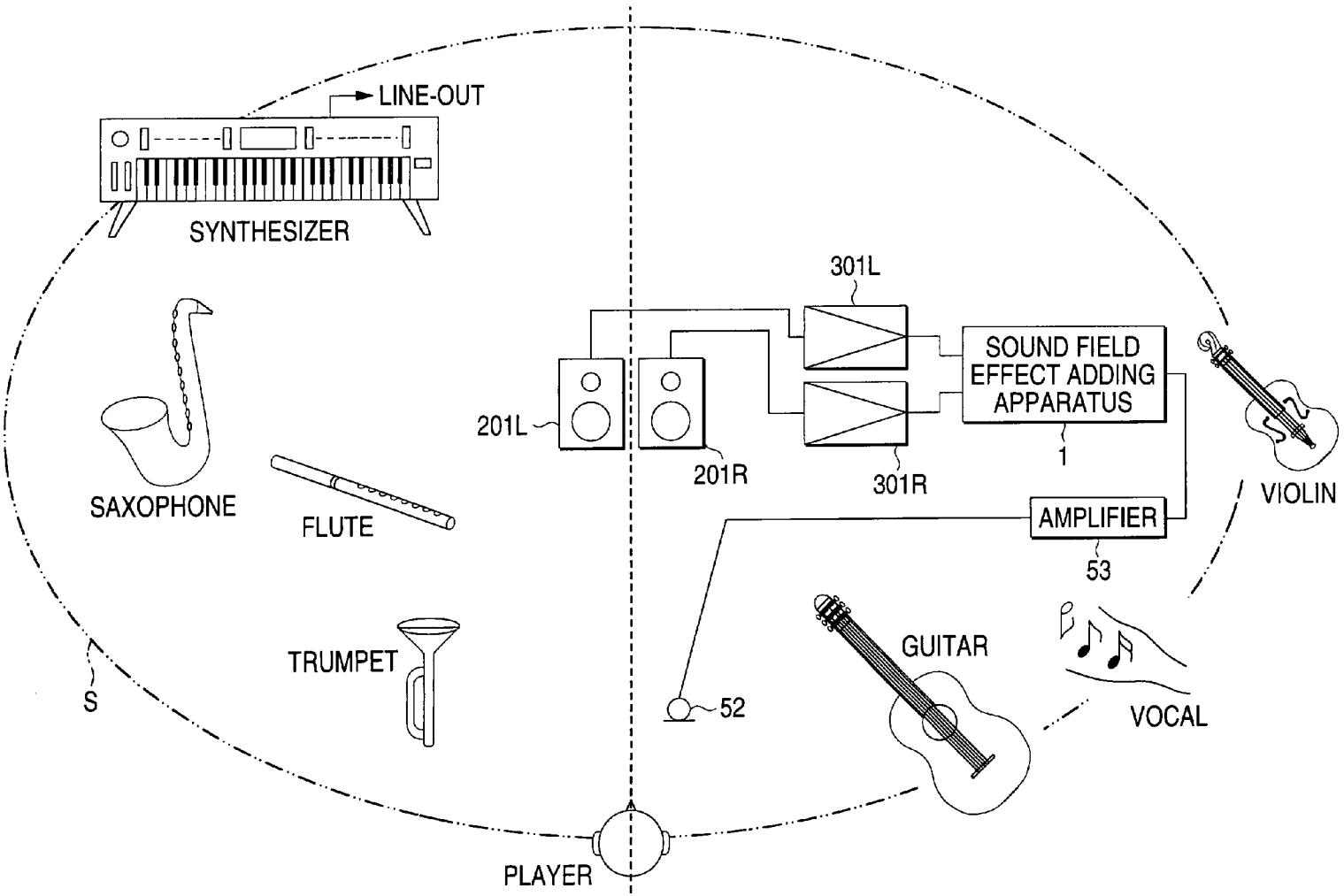
FIG. 13 is a view showing an application example of the three-dimensional sound reproducing apparatus of the invention.

FIG. 13 shows an example in which the embodiment is applied to a music practice room where various instruments such as a saxophone and a flute are played and a vocalist sings. The apparatus is configured in the same manner as that shown in FIG. 12. Thus, the players of the instruments and the vocalist are in front of the loudspeakers 201L and 201R. Therefore, the players and the vocalist receive an impression that the other instruments are played and the other vocal is sung in the area S.

Figure 14:
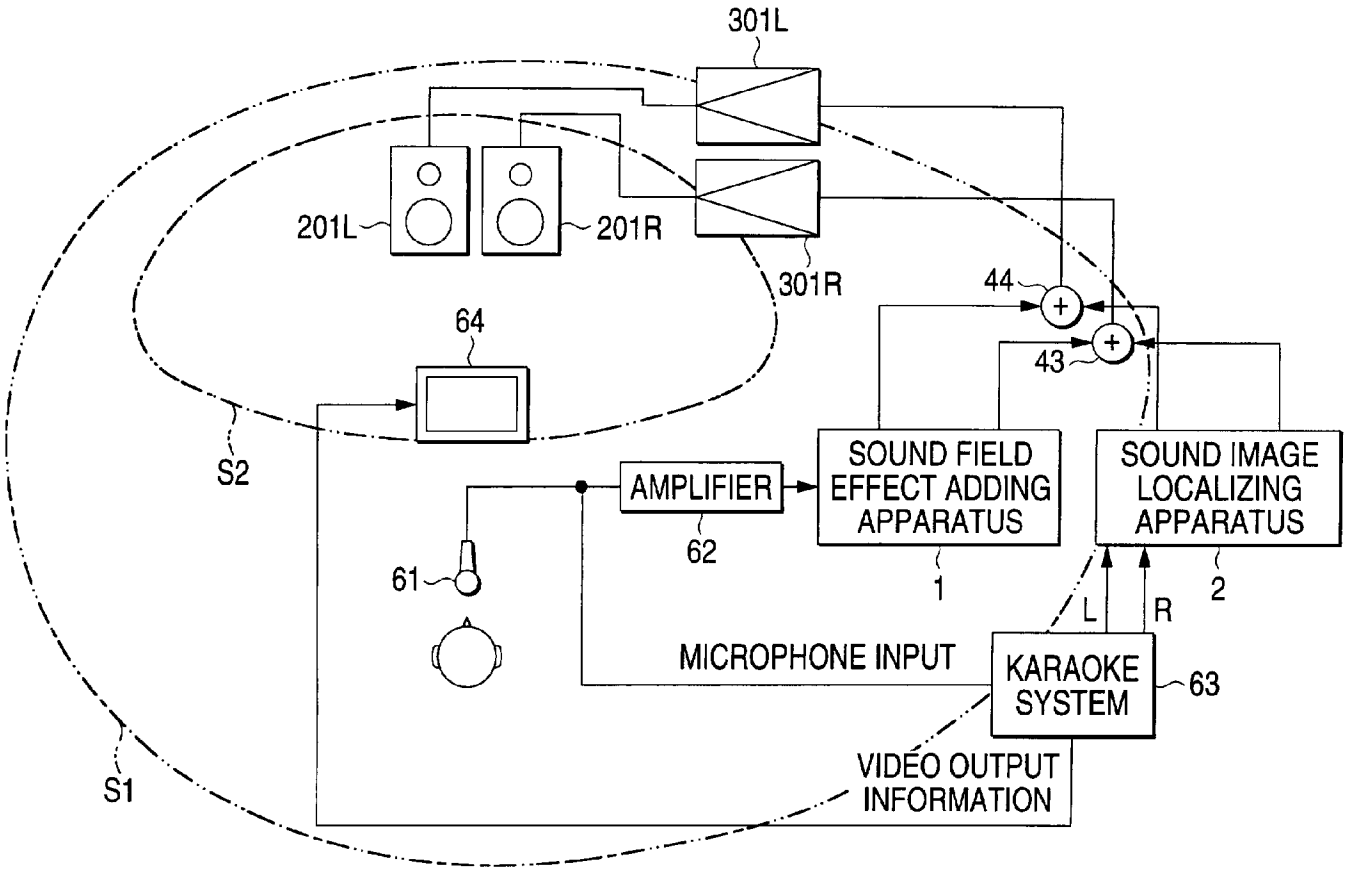
FIG. 14 is a view showing an application example of the three-dimensional sound reproducing apparatus of the invention.

FIG. 14 shows an example in which the embodiment is applied to a karaoke room. As shown in the figure, a microphone 61 and a video monitor 64 are placed in front of the singer. Words and the like are displayed on the video monitor 64 on the basis of video output information supplied from a karaoke system 63. Audio signals such as a vocal sound which are collected from the singer via the microphone 61 are supplied to the karaoke system 63, and also to the sound field effect adding apparatus 1 via an amplifier 62. As a result, two- or left- and right-channel audio signals of the vocal sound to which a sound field effect corresponding to a three-dimensional acoustic space is added are output from the sound field effect adding apparatus 1. In the karaoke system 63, audio signals of accompanying sounds of two or left and right channels are reproduced in accordance with the progress of the -music piece, and the audio signals are supplied to the sound image localizing apparatus 2. As a result, two- or left- and right-channel audio signals of the accompanying sounds to which a predetermined sound image location is added is output from the sound image localizing apparatus 2.

The audio signals output from the sound field effect adding apparatus 1 and the sound image localizing apparatus 2 are subjected to the adding operation by the adders 43 and 44 in such a manner that the audio signals of the same channel are added to each other. The output signals of the adders 43 and 44 are supplied to the loudspeakers 201L and 201R via the power amplifiers 301L and 301R, respectively. As a result, the singer can hear accompanying sounds having a predetermined sound image location, and a vocal sound to which a sound field effect of a predetermined three-dimensional acoustic space is added. In FIG. 14, the symbol S1 shows an example of an area where the field of a vocal sound is formed, and the symbol S2 shows an example of an area where the field of accompanying sounds is formed. In this way, the area where a sound field is to be formed may be adequately determined in accordance with the use.

Second Embodiment

Next, a second embodiment of the invention will be described.

Figure 15:
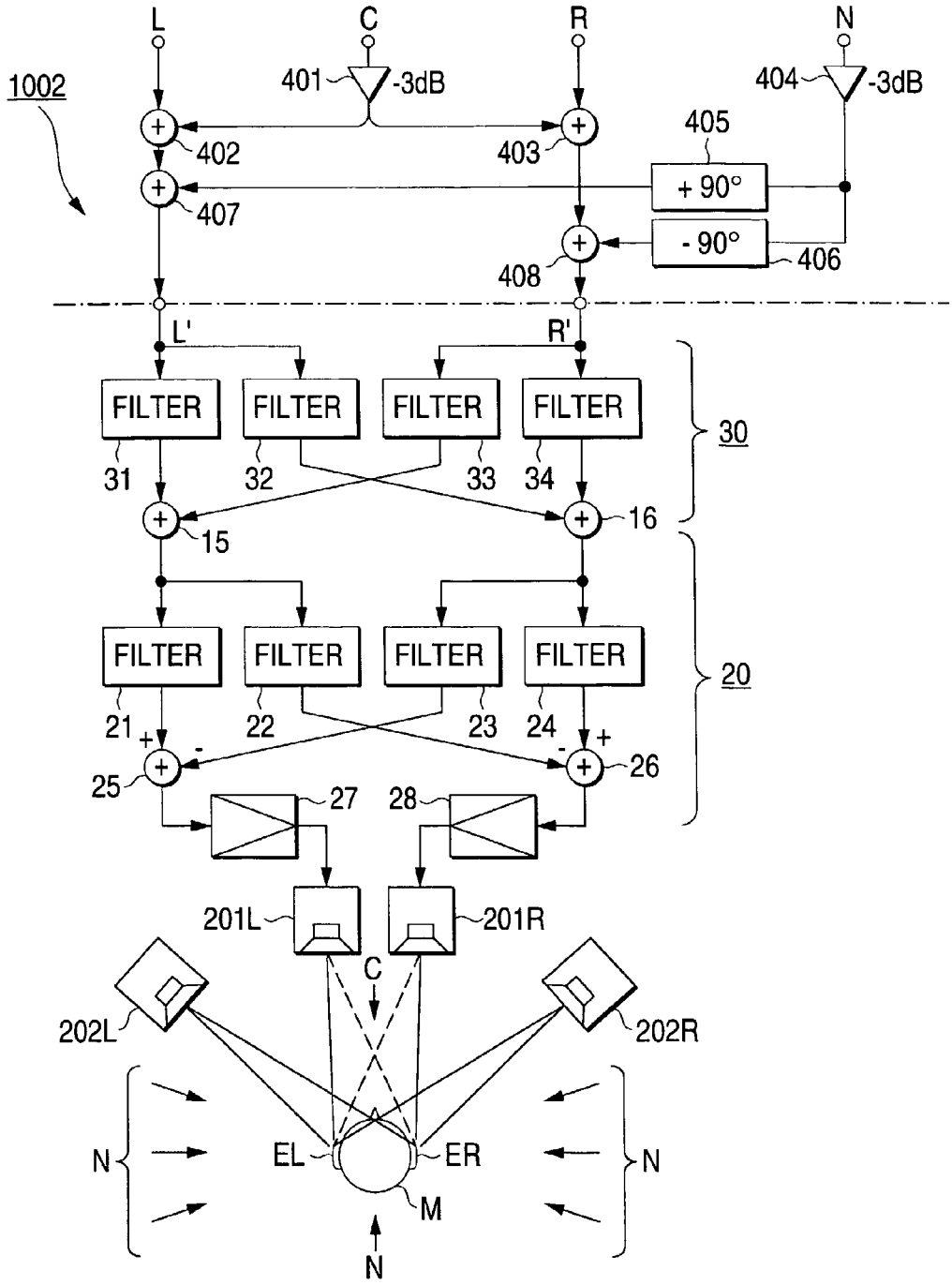
FIG. 15 is a block diagram showing the configuration of a three-dimensional sound reproducing apparatus which is a second embodiment of the invention.

FIG. 15 is a block diagram showing the configuration of a three-dimensional sound reproducing apparatus used for understanding the three-dimensional sound reproduction method of the second embodiment. In the three-dimensional sound reproduction method of the invention, a three-dimensional sound is given to the listener on the basis of a center-channel audio signal C, a left-channel audio signal L, a right-channel audio signal R, and a nonlocalization audio signal N. Two-channel audio signals L' and R' which are obtained by encoding these audio signals are supplied to the three-dimensional sound reproducing apparatus of the second embodiment via communication means or a medium. For example, four-channel sound signals (C, L, R, and S (surround)) for a movie are encoded into two-channel sound signals and then transmitted. In the embodiment, two-channel sound signals of this kind may be treated as an input audio signal. In FIG. 15, in order to facilitate the understanding of the signal processing in the whole system from the recording and the reproduction, an encoder 1002 of the recording system for generating the audio signals L' and R' is indicated in an area above the one-dot chain line of FIG. 15. The encoder 1002 has been described with reference to FIG. 19, and therefore the duplicated description is omitted. Also the description of the portions identical with those of the first embodiment described above is omitted.

As shown in FIG. 15, the three-dimensional sound reproducing apparatus of the embodiment is configured by cascading the sound image localizing unit 30 which provides two-channel audio signals L' and R' with a predetermined sound image location, and the crosstalk canceling unit 20.

The crosstalk canceling unit 20 includes the four filters 21 to 24 and the two subtractors 25 and 26, and conducts a process of preventing crosstalk from occurring on the two-channel audio signals which are output from the sound image localizing unit 30.

The crosstalk canceling unit 20 has been described in detail in the first embodiment. Therefore, the detailed description of the function of the crosstalk canceling unit 20 is omitted. In the embodiment, three-dimensional sound reproduction is conducted by using only the two loudspeakers 201L and 201R which are placed in front of the listener M.

The symbols X and Y in FIG. 5 indicate the two- or left- and right-channel audio signals which are output from the sound image localizing unit 30 of FIG. 15.

Next, the sound image localizing unit 30 of FIG. 15 will be described. In the embodiment, as shown in FIG. 15, audio signals are converted into sounds by the loudspeakers 201L and 201R which are placed in front of the listener. The sound image localizing unit 30 makes sounds corresponding to the audio signals to be heard by the listener as if the sounds are generated by loudspeakers 202L and 202R (virtual loudspeakers which are not actually used) different from the loudspeakers 201L and 201R.

For the sake of simplicity, the case where the sound image of the left-channel audio signal L' is localized at the position of the virtual loudspeaker 202L of FIG. 15 will be described. FIG. 7 shows the example of the positional relationships between the virtual loudspeaker 202L and the left and right ears EL and ER of the listener. In this example, the virtual loudspeaker 202L is in the direction of an angle θ with respect to the front of the listener, and a sound generated by the virtual loudspeaker 202L is transmitted to the left ear EL along the path of the transfer function HL and to the right ear ER along the path of the transfer function HR.

In order to localize the sound image of the left-channel audio signal L' at the position of the virtual loudspeaker 202L, filters having transfer functions which respectively correspond to the transfer functions HL and HR are used as the filters 31 and 32. When the left-channel audio signal L' is supplied to the filters 31 and 32, audio signals of waveforms strictly identical with those of sounds which are heard by the left and right ears EL and ER of the listener when the audio signal is output as a sound from the virtual loudspeaker 202L of FIG. 15 are obtained from the filters.

The audio signals output from the filters 31 and 32 are supplied to the left and right loudspeakers 201L and 201R via the crosstalk canceling unit 20 and power amplifiers 27 and 28, respectively. Therefore, sounds corresponding to the audio signals of the respective channels output from the filters 31 and 32 can be independently transmitted to the left and right ears of the listener irrespective of the distances between the loudspeakers 201L and 201R and the listener. As a result, the image of the audio signal L' can be localized at the position of the loudspeaker 202L.

In the above, the case of the left-channel audio signal L' has been described. Also the right-channel audio signal R' can be processed in the same manner. Namely, transfer functions for localizing the sound image of the audio signal R' at the position of the virtual loudspeaker 202R shown in FIG. 15 are previously obtained, and filters 33 and 34 having such transfer functions are used.

The audio signals L' and R', which are to be processed by the embodiment, have the following components:

a. Components of the audio signal L'
   left-channel audio signal L
   center-channel audio signal C
   signal which leads in phase by 90 deg. the nonlocalization audio signal N
   b. Components of the audio signal R'
      left-channel audio signal R
      center-channel audio signal C
      signal which delays in phase by 90 deg. the nonlocalization audio signal N The above-described processes of the sound image localizing unit 30 and the crosstalk canceling unit 20 are conducted on the audio signals L' and R' which are integrated wholes including the components. In the following, the effects of the processes for each of the components will be discussed.

(1) Left- and Right-Channel Audio Signals L and R

The sound images corresponding to the audio signals are localized at the positions of the virtual loudspeakers 202L and 202R by the function of the sound image localizing unit 30 described above, respectively.

(2) Center-Channel Audio Signal C

The sound image of the center-channel audio signal C in the audio signal L' is localized at the position of the virtual loudspeaker 202L, and that of the center-channel audio signal C in the audio signal R' is localized at the position of the virtual loudspeaker 202R. However, the sound images correspond to the same sound. Therefore, the sound image corresponding to the center-channel audio signal C is eventually localized at the midpoint between the virtual loudspeakers 202L and 202R, i.e., at the center.

(3) Nonlocalization Audio Signal N

The audio signal L' contains the signal which leads in phase by 90 deg. the nonlocalization audio signal N, and the audio signal R' the signal which delays in phase by 90 deg. the nonlocalization audio signal N. These signals are transmitted to the left and right ears EL and ER of the listener, respectively. In this way, the audio signals which are separated from each other in phase by 180 deg. are supplied to the left and right ears EL and ER, respectively. Therefore, the listener cannot sense localization, so that the listener hears a sound corresponding to the nonlocalization audio signal N in an uncertain direction.

As described above, according to the embodiment, an adequate sound image can be given to the center-channel audio signal C, the left-channel audio signal L, the right-channel audio signal R, and the nonlocalization audio signal N by using only two loudspeakers which are positioned in front of the listener, thereby providing the listener with a three-dimensional sound with plentiful presence. According to the embodiment, it is required to use only two systems of a loudspeaker and a power amplifier for driving the loudspeaker, and hence a three-dimensional sound reproducing apparatus which is simple in structure and easy to operate can be configured. Since the listener can hear all the sounds corresponding to the audio signals in directions along which the loudspeakers are not positioned, it is possible to obtain presence which cannot be obtained in a conventional acoustic system.

Third Embodiment

Figure 16:
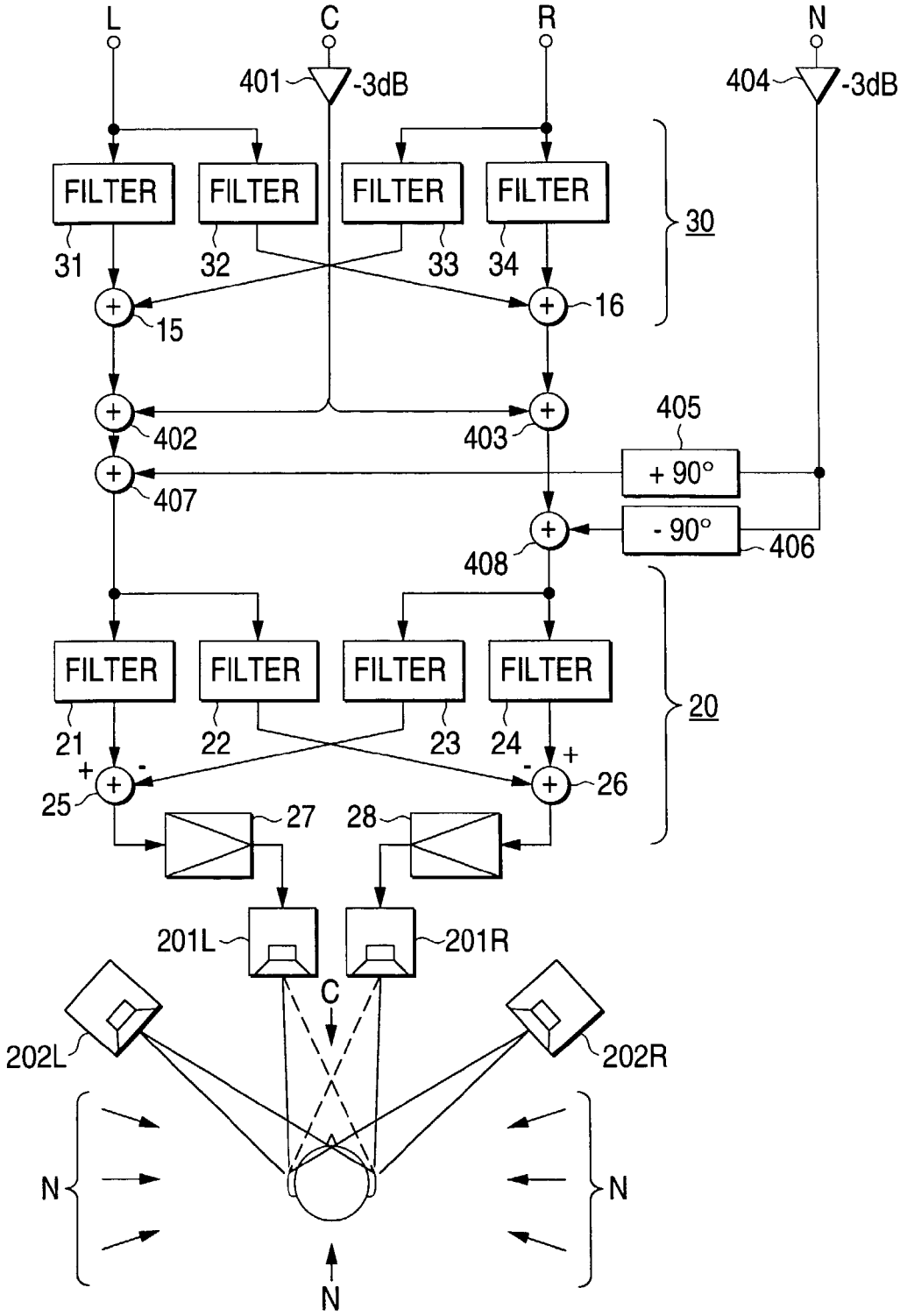
FIG. 16 is a block diagram showing the configuration of a three-dimensional sound reproducing apparatus which is a third embodiment of the invention.
Figure 17:
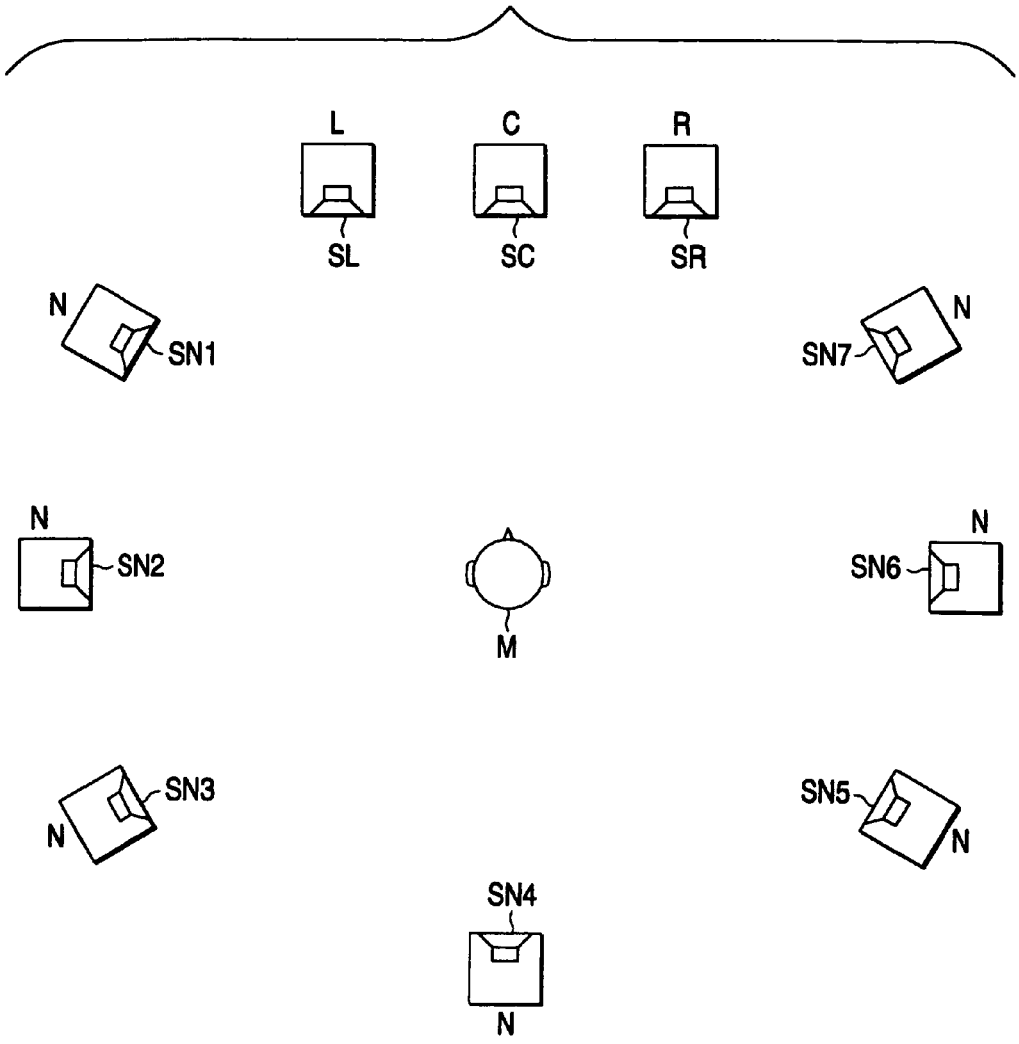
FIG. 17 is a view showing the configuration of a conventional multispeaker system.
Figure 18:
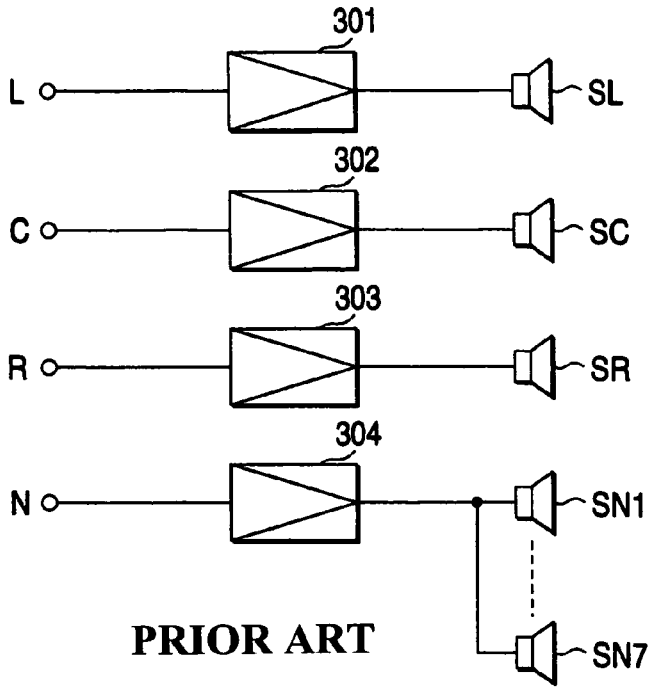
FIG. 18 is a view showing the manner of supplying audio signals in the system of FIG. 17.
Figure 19:
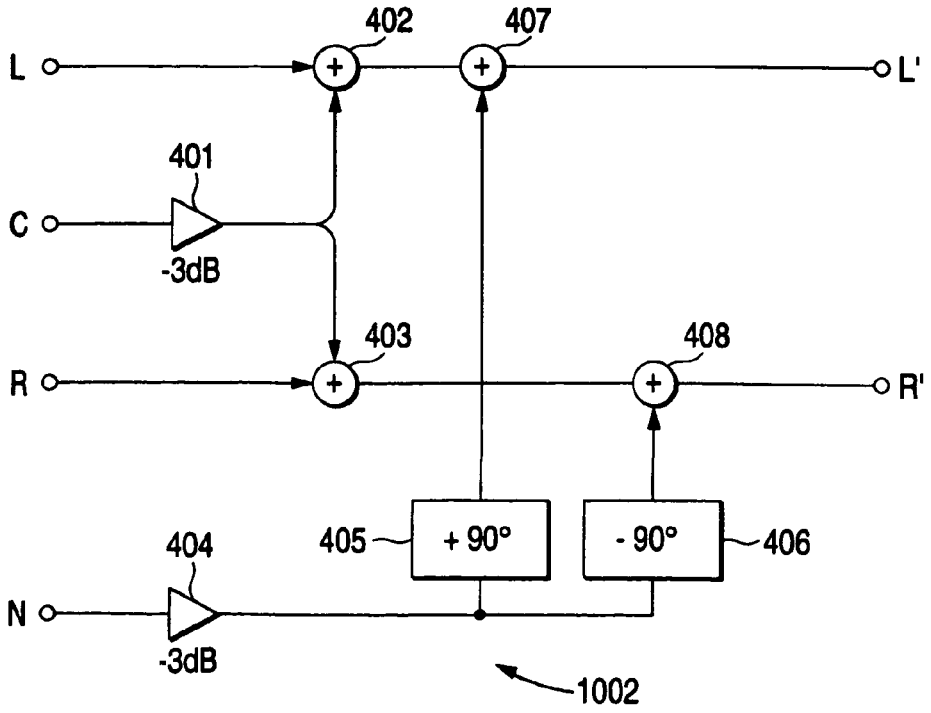
PRIOR ART FIG. 19
FIG. 19 is a block diagram showing the configuration of an encoder used in the system of FIG. 17.
Figure 20:
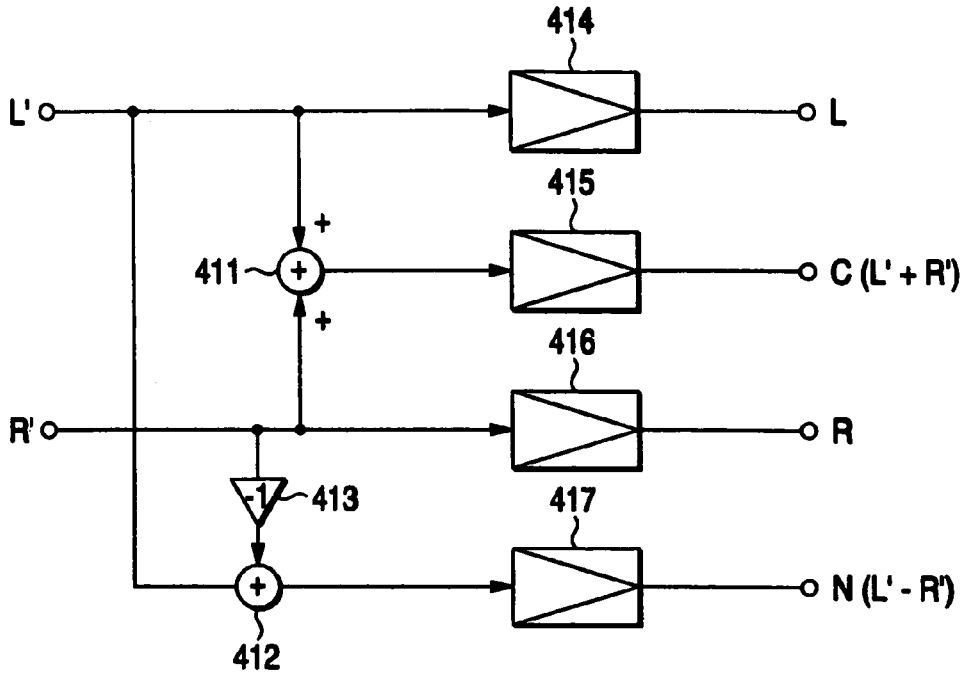
FIG. 20 is a block diagram showing the configuration of a decoder used in the system of FIG. 17.

FIG. 16 is a block diagram showing the configuration of a three-dimensional sound reproducing apparatus which is a third embodiment of the invention. The three-dimensional sound reproducing apparatus of the second embodiment described above handles the audio signals L' and R' which are encoded into two-channel signals. By contrast, the three-dimensional sound reproducing apparatus of the present embodiment handles four-channel audio signals C, L, R, and N which are not encoded. The crosstalk canceling unit 20 is configured so as to handle two-channel audio signals. Consequently, the amplifier 401, the adders 402 and 403, and the like of the encoder 1002 shown in FIG. 19 are additionally disposed in the three-dimensional sound reproducing apparatus.

The four-channel audio signals C, L, R, and N undergo signal processing in the following manner until the signals reach the crosstalk canceling unit 20.

The left- and right-channel audio signals L and R are supplied to the sound image localizing unit 30. The sound image localizing unit 30 generates two-channel audio signals in which the sound image of the left-channel audio signal L is localized at the position of the virtual loudspeaker 202L and the sound image of the right-channel audio signal R is localized at the position of the virtual loudspeaker 202R. The two-channel audio signals are output from adders 15 and 16, respectively.

The center-channel audio signal C is provided with attenuation of −3 dB by the amplifier 401. The output signal of the amplifier 401 is added by the adders 402 and 403 to the two-channel audio signals.

The nonlocalization audio signal N is supplied to the phase shifters 405 and 406. The phase shifters 405 and 406 respectively generate a signal which leads in phase by 90 deg. the nonlocalization audio signal N, and that which delays in phase by 90 deg. the nonlocalization audio signal. The generated signals are added to the output signals of the adders 402 and 403 by the adders 407 and 408. The output signals of the adders 407 and 408 are supplied to the crosstalk canceling unit 20. Also, one of phase invertor may be used in stead of the phase shifters 405 and 406.

In the third embodiment, the center-channel audio signal C and the nonlocalization audio signal N are directly supplied to the crosstalk canceling unit 20. Therefore, the embodiment has an advantage that the sound image localizing unit 30 is not required to process the signals. Since the sound image of the center-channel audio signal C is requested to be localized at the center, it is required to supply the center-channel audio signal merely to the loudspeakers 201L and 201R. The nonlocalization audio signal N is originally a signal in which the sound image is not to be localized. Therefore, these signals are not required to pass through the sound image localizing unit 30. The other portions are configured in the same manner as those of the second embodiment described above.

In the second embodiment, since the center-channel audio signal C and the nonlocalization audio signal N are contained in the two-channel audio signals L' and R', also the signals are processed by the sound image localizing unit 30. Also in this case, the components of the audio signals L' and R' are adequately treated in the same manner as described above.

As described above, according to the invention, the apparatus includes: a sound field effect adding unit that adds a predetermined three-dimensional sound field effect to an input audio signal, thereby generating two- or left- and right-channel audio signals; and a crosstalk canceling unit that performs a calculation process on the audio signals of the two channels so that, when the audio signals are respectively generated by two loudspeakers positioned in front of a listener, the audio signals reach left and right ears of the listener without producing crosstalk. Therefore, the invention has an advantage that a sound field effect equivalent to that obtained in a three-dimensional acoustic space can be obtained by using two loudspeakers only or without using a number of loudspeakers.

Furthermore, the invention has an advantage that a three-dimensional sound with plentiful presence can be provided by using two loudspeakers only or without using a number of loudspeakers.

What is claimed is:

1. A three-dimensional sound reproduction method, comprising:

providing two-channel first audio signals defining sound images which are to be respectively localized on left and right sides of a listener, a center-channel audio signal defining a sound image to be localized at a center, and nonlocalization audio signals, by one of reproducing from a medium and receiving from an outside source;

conducting sound localization processes respectively corresponding to transfer functions of paths from a virtual point in a three-dimensional acoustic space to left and right ears of the listener on the two-channel first audio signals, to generate two-channel second audio signals defining a sound image to be localized at the virtual point;

conducting a phase shifting process on the nonlocalization audio signals two-channel nonlocalization audio signals separated in phase by 180 degrees from each other;

adding the center-channel audio signal commonly, and the two-channel nonlocalization audio signals, on which the sound localization process is not conducted, respectively, to the two-channel second audio signals to generate two-channel third audio signals; and conducting a crosstalk canceling process on the two-channel third audio nonlocalization signals to generate two-channel fourth audio signals, so that when the two-channel fourth audio signals are respectively generated by two loudspeakers positioned in front of the listener, the two-channel fourth audio signals reach the left and right ears of the listener without producing crosstalk.

2. The three-dimensional sound reproduction method according to claim 1, wherein the two loudspeakers area adjacently arranged side-by-side.

3. A three-dimensional sound reproduction apparatus, comprising:

a sound signal generating device for generating two-channel first audio signals defining sound images which are to be respectively localized on left and right sides of a listener, a center-channel audio signal defining a sound image to be localized at a center, and nonlocalization audio signals, by one of reproducing from a medium and receiving from an outside source;

a sound localization device for conducting sound localization processes respectively corresponding to transfer functions of paths from a virtual point in a three-dimensional acoustic space to left and right ears of the listener on the two-channel first audio signals, to generate two-channel second audio signals defining a sound image to be localized at the virtual point;

a phase-shifting device for conducting a phase shifting process on the nonlocalization audio signals to generate two-channel nonlocalization audio signals separated in phase by 180 degrees from each other;

an addition device for adding the center-channel audio signal commonly, and the two-channel nonlocalization audio signals, on which the sound localization is not conducted, respectively, to the two-channel second audio signals to generate two-channel third audio signals; and a crosstalk canceling device for conducting a crosstalk canceling process on the two-channel third audio signals to generate two-channel fourth audio signals, so that when the two-channel fourth audio signals are respectively generated by two adjacently arranged side-by-side loudspeakers positioned in front of the listener, the two-channel fourth audio signals reach the left and right ears of the listener without producing crosstalk.

4. A three-dimensional sound reproducing apparatus, comprising:

a sound signal generating apparatus for generating two-channel first audio signals defining sound images which are to be respectively localized on left and right sides of a listener and a nonlocalization signal;

a sound localization device for conducting sound localization processes respectively corresponding to transfer functions of paths from a virtual point in a three-dimensional acoustic space to left and right ears of the listener on the two-channel first audio signals, to generate two-channel second audio signals defining a sound image to be localized at the virtual point;

a phase shift device for conducting a phase shifting process on the nonlocalization signal to generate two-channel nonlocalization audio signals which are separated in phase by 180 degrees from each other;

an addition device for adding the two-channel nonlocalization signals, on which the sound localization process is not conducted, to the two-channel second audio signals, respectively, to generate two-channel third audio signals; and a crosstalk canceling device for conducting a crosstalk canceling process on each of the two-channel third audio signals to generate two-channel fourth audio signals, so that when left and right two-channel sound signals are generated by two adjacently arranged side-by-side sound loudspeakers, the left and right two-channel fourth sound signals reach the left and right ears of the listener without producing crosstalk.

5. A three-dimensional sound reproduction method, comprising:

providing two-channel first audio signals defining sound images which are to be respectively localized on left and right sides of a listener, and nonlocalization audio signals, by one of reproducing from a medium and receiving from an outside source;

conducting sound localization processes respectively corresponding to transfer functions of paths from a virtual point in a three-dimensional acoustic space to left and right ears of the listener on the two-channel first audio signals, to generate two-channel second audio signals defining a sound image to be localized at the virtual point;

conducting a phase shifting process on the nonlocalization signal to generate two-channel nonlocalization audio signals separated in phase by 180 degrees from each other; and adding the two-channel nonlocalization signals, on which the sound localization process is not conducted, to the two-channel second audio signals, respectively, to generate two-channel third audio signals;

conducting crosstalk canceling process on the two-channel third audio signals to generate left and right two-channel fourth sound signals, so that when the left and right two-channel sound signals are generated by two sound loudspeakers, the left and right two-channel fourth sound signals reach the left and right ears of the listener without producing crosstalk.

* * * * *

UNITED STATES PATENT AND TRADEMARK OFFICE

CERTIFICATE OF CORRECTION

PATENT NO. : 7,076,068 B2
APPLICATION NO. : 10/231741
DATED : July 11, 2006
INVENTOR(S) : Hiromi Sotome et al.

It is certified that error appears in the above-identified patent and that said Letters Patent is hereby corrected as shown below:

On title page, item 75, Inventors
delete "Akio Takahashi"

Signed and Sealed this

Eighteenth Day of September, 2007

JON W. DUDAS
*Director of the United States Patent and Trademark Office*